US006590490B2

(12) United States Patent
Ackermann

(10) Patent No.: US 6,590,490 B2
(45) Date of Patent: Jul. 8, 2003

(54) TIME DELAY FUSE

(75) Inventor: John Marvin Ackermann, Belleville, IL (US)

(73) Assignee: Cooper Technologies Company, Houston, TX (US)

( * ) Notice: Subject to any disclaimer, the term of this patent is extended or adjusted under 35 U.S.C. 154(b) by 25 days.

(21) Appl. No.: 09/860,533

(22) Filed: May 18, 2001

(65) Prior Publication Data

US 2002/0171532 A1 Nov. 21, 2002

(51) Int. Cl.[7] ..... H01H 85/04

(52) U.S. Cl. ..... 337/290; 337/142; 337/163; 337/273

(58) Field of Search ..... 337/142, 273, 337/282, 286, 290, 292, 295, 163

(56) References Cited

U.S. PATENT DOCUMENTS

| | | | | |
|---|---|---|---|---|
| 3,609,621 A | | 9/1971 | Danesi | |
| 4,417,224 A | | 11/1983 | Ross | |
| 4,680,567 A | | 7/1987 | Edwards | |
| 4,713,644 A | * | 12/1987 | Nash et al. | 218/118 |
| 4,992,770 A | | 2/1991 | Spalding et al. | |
| 4,994,779 A | | 2/1991 | Douglass | |
| 5,075,664 A | | 12/1991 | Spalding et al. | |
| 5,077,534 A | | 12/1991 | Douglass | |
| 5,150,093 A | | 9/1992 | Gurevich | |
| 5,153,553 A | * | 10/1992 | Ruehl et al. | 337/273 |
| 5,247,274 A | | 9/1993 | Gurevich | |
| 5,361,058 A | | 11/1994 | Mosesian et al. | |
| 5,631,619 A | * | 5/1997 | Evans | 337/166 |
| 5,722,432 A | * | 3/1998 | Luke et al. | 131/349 |

FOREIGN PATENT DOCUMENTS

| | | |
|---|---|---|
| GB | 2029131 A | 3/1980 |
| GB | 2148625 A | 5/1985 |

OTHER PUBLICATIONS

Search Report Under Section 17, Oct. 10, 2002, Patents Act 1977, Appln. No. GB 0210922.1; Examiner: Phil Thorpe.

* cited by examiner

*Primary Examiner*—Jayprakash N. Gandhi
(74) *Attorney, Agent, or Firm*—Armstrong Teasdale LLP

(57) ABSTRACT

In an exemplary embodiment of the invention, a fuse element for a time delay fuse includes a conductive fuse element member, a fuse link formed within the member, and a heat sink coupled to the member. The heat sink draws heat from the fuse element member and prevents the fuse link from opening for an increased amount of time during high current overload conditions.

15 Claims, 1 Drawing Sheet

TIME DELAY FUSE

BACKGROUND OF THE INVENTION

This invention relates generally to fuses, and, more particularly, to time delay fuses.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and opens one or more circuits through the fuses to prevent electrical component damage.

A time delay fuse is a type of fuse that has a built-in delay that allows temporary and harmless inrush currents to pass through the fuse without opening the fuse link or fuse links, yet is designed to open upon sustained overloads or short circuit conditions. For example, conventional time-delay fuses typically allow five times the rated current for up to ten seconds without opening, and therefore are particularly suited for applications including circuits subject to inrush current transients, such as electric motors that draw relatively large motor starting currents of a relatively short duration as the motors are energized. In certain circumstances, however, it is desirable to provide a longer time delay than is typically possible with conventional time delay fuses.

BRIEF SUMMARY OF THE INVENTION

In an exemplary embodiment of the invention, a fuse element for a time delay fuse includes a conductive fuse element member, a fuse link formed within the member, and a heat sink coupled to the member. The heat sink draws heat from the fuse element member and prevents the fuse link from opening for an increased amount of time during relatively high current overload conditions, while substantially unaffecting time delay performance at relatively low current overload conditions.

More specifically, the heat sink is a nickel thermal load in one embodiment of the invention. The fuse element member is substantially flat and includes opposite faces, and the heat sink is coupled to and engages the opposite faces to ensure heat transfer from the fuse element member. In a further embodiment, the heat sink is U-shaped and wraps around the fuse element member.

The heat sink may be used in combination with other known time delay features for improved effectiveness. For instance, in one embodiment, the conductive fuse element member includes an outer surface and is fabricated from a first conductive material, and the fuse element includes a low melting alloy fabricated from a second material applied to the outer surface. This results in a known M effect, wherein the fuse element operates at lower temperatures than it would otherwise operate in the absence of the low melting point alloy. Combined effects of an M effect alloy and the heat sink substantially increase time delay performance of the fuse element at relatively high overload currents, thereby preventing premature opening of the fuse element during relatively high transient overload currents.

DETAILED DESCRIPTION OF THE INVENTION

Figure 1:
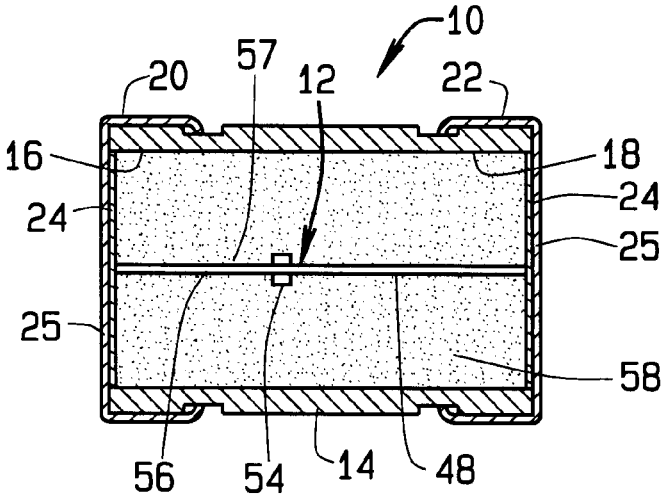
FIG. 1 is cross-sectional view of a time delay fuse.
Figure 2:
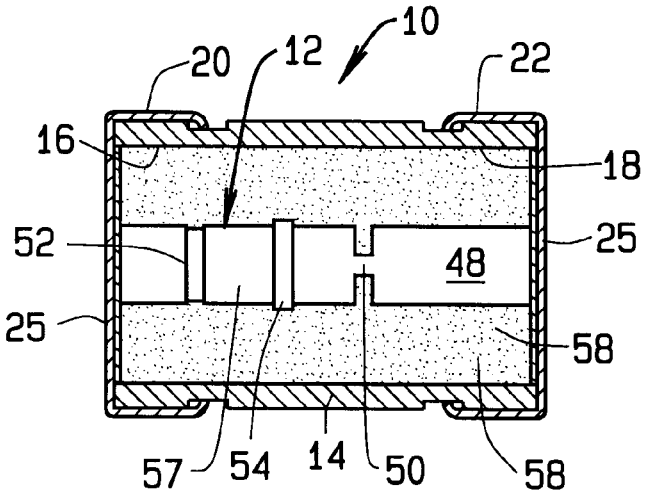
FIG. 2 is a cross-sectional view similar to FIG. 1 but with the fuse rotated 90°.

FIGS. 1 and 2 are cross-sectional views of an exemplary time delay fuse 10 in which the present invention may be employed. Fuse 10 is but one type of fuse in which the invention may be practiced. It is recognized that there are many types of time delay fuses which may benefit from the present invention. Thus, the following description of fuse 10 is for illustrative purposes only rather than by way of limitation. It is contemplated that the present invention may be practiced in a large variety of time delay fuses without departing from the scope of the present invention.

Fuse 10 includes a fuse element subassembly 12 disposed within an insulative fuse body 14 having opposite ends 16, 18, and conductive endcaps or ferrules 20, 22 attached to fuse body ends 16, 18, respectively. Fuse subassembly 12 extends between and is in electrical contact with ferrules 20, 22 to complete an electrical connection through fuse 10 when ferrules 20, 22 are coupled to an energized circuit (not shown). In one embodiment, ferrules 20, 22 are coated on an interior flat end surface 24 with a solder coating 25 and crimped and heated onto body ends 16, 18 when fuse 10 is assembled.

When ferrules 20, 22 are coupled to an energized electrical circuit (not shown) an electrical circuit is completed through fuse 10, and more specifically through fuse element subassembly 12. When short circuit conditions occur, or upon the occurrence of sustained overload conditions, fuse element subassembly 12 opens or otherwise breaks an electrical connection through fuse 10, as described further below. Thus, load side electrical circuits and equipment may be isolated from damaging line side fault currents.

Fuse element subassembly 12, in one embodiment, includes a substantially flat fuse element member 48 fabricated from a conductive material. In one embodiment, fuse element member 48 is fabricated from a flat strip of conductive material, and includes a weak spot, or area of reduced cross sectional area relative to a remainder of fuse element member 48, thereby forming a fuse link 50 located between ferrules 20 and 22. In the illustrated embodiment, fuse link 50 includes a narrowed region or necked portion having a reduced cross sectional area compared to a remainder of fuse element member 48. Hence, as current flows through fuse element member 48, fuse link 50 is heated to a higher temperature than a remainder of fuse element member 48. Fuse element member 48 therefore tends to open, melt, disintegrate or otherwise fail in the vicinity of fuse link 50, thereby breaking an electrical connection through fuse element subassembly 12 upon short circuit conditions or other fault conditions, including sustained overload conditions. Fuse element member 48 is dimensioned to carry transient currents of, for example, five to eight times the rated current of fuse 10 without opening, but will open almost instantaneously upon high currents experienced in short circuit conditions.

While the illustrated fuse element member 48 includes a single fuse link 50 or weak spot, in an alternative embodiment a plurality of weak spots or narrowed regions of reduced cross sectional area could be employed and located at equal or unequal spaced intervals from one another. It will be appreciated by those in the art that weak spots or fuse links could alternatively be formed according to other methods and techniques known in the art, such as, for example, forming holes in fuse element 26 rather than the illustrated narrowed or necked portion. In addition, a plurality of fuse element members 48 could be employed in fuse 10 and connected in parallel to one another to increase current capacity and accordingly increase a rating of fuse 10. In still further alternative embodiments, fuse element member 48 is bent in a zig-zag fashion or otherwise extended in a non-linear fashion within fuse body 14, including but not limited to spiral or curvilinear portions in lieu of the above-described and illustrated substantially flat fuse element member 48 to increase an operative length of fuse subassembly 12 and therefore vary operating performance parameters of fuse 10.

In an exemplary embodiment, fuse element member 48 is fabricated from a relatively low-melting point alloy or metal such as zinc, or alternatively, for example, from a silver or copper element having an M effect alloy overlay 52 (low melting alloy spot) or M spot thereon to produce an M effect, sometimes referred to as a "Metcalf effect" in operation of fuse element member 48.

More specifically, in an exemplary embodiment, fuse element member 48 is at least partially coated with overlay 52 of a conductive metal that is different from a composition of fuse element member 48. In one illustrative embodiment, for example, fuse element member 48 is fabricated from copper or silver and overlay 52 is fabricated from tin. As tin has a lower melting temperature than copper or silver, overlay 52 is heated to a melting temperature in an overcurrent condition before copper or silver fuse element 26. The melted overly 52 then reacts with copper or silver fuse element member 48 and forms a tin-copper alloy that has a lower melting temperature than either metal by itself. As such, an operating temperature of fuse element member 48 is lowered in an overcurrent condition, and fuse element member 48 is prevented from reaching the higher melting point of silver or copper. Thus, conductive characteristics and advantages of copper or silver are utilized while avoiding, or at least delaying, undesirable operating temperatures. In alternative embodiments, other conductive materials may be used to fabricate fuse element member and overlay 52, including but not limited to copper and silver alloys and tin alloys, respectively, to achieve similar benefits. In further alternative embodiments, overlay 52 is fabricated from antimony or indium.

The use of overlay 52 does not appreciably alter the electrical resistance of fuse element member fuse link 50, i.e., the weak point, since the electrical resistivity of alloy 52 is significantly higher than that of the parent metal of fuse element member 48. Thus, in effect, M effect alloy 52, by lowering the operating temperature of fuse element member 48, allows fuse element member 48 to withstand temporarily higher currents than the parent material of fuse element member 48 would otherwise allow. As it takes some time for M effect alloy 52 to operate, a time delay is created before fuse element member 48 opens at either the area of alloy 52 or fuse link 50.

Overlay 52 is applied to fuse element member 48 using known techniques, including for example, gas flame and soldering techniques. Alternatively, other methods, including but not limited to electrolytic plating baths, thin film deposition techniques, and vapor deposition processes may be employed. Using these techniques, in various embodiments overlay 52 is applied to some or all of fuse element member 48. For example, in the illustrated embodiment, overlay 52 is applied to fuse element member 48 in a thin strip. In another embodiment, only a central portion of a fuse element 48 includes overlay 52. In still a further alternative embodiment, an entire surface area of a fuse element member 48 includes overlay 52. In a further embodiment, overlay 52 is applied on one side only of fuse element member 48, while in a different embodiment, both sides of a fuse element member 48 include M effect overlay 52.

To further increase a time delay of opening fuse element member 48, fuse element member 48 includes a heat sink 54 coupled to fuse element member 48 between M effect alloy 52 and fuse link 50. In one embodiment, heat sink 54 is a nickel thermal load applied to fuse element member 48 in wrap-around fashion so that heat sink 54 is engaged to opposite sides 56, 57, or opposite faces of fuse element member 48. For example, in one embodiment, heat sink 54 is a U-shaped element with interior legs of the U contacting respective opposite surfaces 56, 57 of fuse element member 48 (as best illustrated in FIG. 1). In another exemplary embodiment, heat sink 54 is a circular disk of nickel thermal load with a slot formed partially through the disk for receiving fuse element member 48. It is recognized that many other shapes of heat sink 54 may be employed to serve the basis purpose of contacting a surface of fuse element member 48, such as surfaces 56, 57 to draw heat from fuse element 48 in operation.

Heat sink 54 is coupled to fuse element 48 by clamping action or another known technique to securely couple heat sink 54 to fuse element member 48 and ensure an electrical connection therebetween. It is contemplated that a variety of known heat sink materials having an adequate temperature coefficient of resistance may be used in lieu of, or in addition to, nickel thermal load for fabricating heat sink 54. Specifically, in alternative embodiments, copper, aluminum, silver and other materials having appropriate thermal diffusivity in relation to fabrication materials of fuse element member 48 and M effect alloy 52 to obtain specified time delay characteristics for fuse 10.

A location of heat sink 54 may vary from fuse to fuse, but M effect alloy 52 is generally positioned at a point of fuse element member 48 that is otherwise warmest in operation if thermal load were not present. Thus, the increased mass of heat sink 54 draws additional heat from fuse element member 48 that would otherwise contribute to heating of fuse link 50, and thus further extending the required time to heat fuse link 50 to a melting temperature in fault current conditions.

In one embodiment, M effect alloy 52 and the weak spot of fuse element sub-assembly 12 are positioned relative to one another so as to create an asymmetrical temperature distribution in fuse element subassembly 12, and heat sink 54 is further located at the "hot spot" or warmest operating point of the asymmetrical temperature distribution. In this manner, the time delay for opening fuse 10 at high currents (e.g., about 233% of the rated current of the fuse) may be increased while substantially unaffecting the time delay for opening fuse 10 at lower currents (e.g., about 110% to about 135% of the rated current of the fuse). Premature opening of fuse 10 due to high transient currents is therefore avoided.

By employing heat sink 54 in addition to M effect alloy 52, time delays may be considerably improved relative to conventional time delay fuses. For example, using the above-described fuse element subassembly construction, in an exemplary embodiment a fuse rated at 30A was found to reliably withstand a 60A current for more than 40 seconds and a 70A current for more than 20 seconds without opening, while time delay characteristics at, for example, 40.5A current were substantially comparable to conventional time delay fuses. Similar results may be likewise obtained for fuses of different fuse ratings. Such time delay performance at high current values unobtainable in conventional time delay fuses is therefore provided with minimal cost impact by virtue of low material costs and straightforward assembly of fuse element subassembly 12.

To minimize arcing when fuse 10 opens, an arc quenching medium is employed within tubing 14 adjacent the fusing components. In one embodiment, a solid matrix filler 58 fabricated from sand, sodium silicate (water glass) and distilled water in a wet stoning process is packed about fuse element subassembly 12. In alternative embodiments other known arc extinguishing and arc suppressing media may be employed, including but not limited to silica sand, and the arc extinguishing medium may be applied using other methods and techniques known in the art.

While the invention has been described in terms of various specific embodiments, those skilled in the art will recognize that the invention can be practiced with modification within the spirit and scope of the claims.

What is claimed is:

1. A fuse element for a time delay fuse comprising:

a conductive fuse element member comprising an outer surface and fabricated from a first conductive material, said fuse element comprising a low melting alloy fabricated from a second material applied to said outer surface;

a fuse link formed within said member; and a heat sink coupled to said member.

2. A fuse element in accordance with claim 1 wherein said heat sink comprises a nickel thermal load.

3. A fuse element in accordance with claim 1, said fuse element member comprising opposite faces, said heat sink coupled to and engaging said opposite faces.

4. A fuse element in accordance with claim 1, said heat sink located between said low melting point alloy and said fuse link.

5. A fuse element in accordance with claim 4, said heat sink located to coincide with a warmest operating region of said fuse element member.

6. A time delay fuse comprising:

an insulative fuse body;

first and second conductive ferrules attached to said fuse body; and a fuse element extending between said first and second ferrules within said fuse body, said fuse element comprising a fuse link and a heat sink.

7. A fuse in accordance with claim 6, said first fuse element further comprising an outer surface and a low melting point alloy applied to said outer surface.

8. A fuse in accordance with claim 7, said heat sink located between said low melting point alloy and said fuse link.

9. A fuse in accordance with claim 7 wherein said heat sink comprises nickel thermal load.

10. A fuse in accordance with claim 6 wherein said fuse element comprises opposite outer surfaces, said heat sink engaged to and forming an electrical connection with said outer surfaces.

11. A single element time delay fuse comprising:

an insulative fuse body;

first and second conductive ferrules attached to said fuse body;

a fuse element extending between said first and second ferrules within said fuse body, said fuse element comprising a fuse link formed within said element and an M effect alloy coated on a surface of said fuse element, said fuse element and said M effect alloy creating an asymmetric operating temperature distribution in said fuse element; and a heat sink engaged to said fuse element, said heat sink increasing time delay performance under high current overload conditions, and substantially unaffecting time delay characteristics during low current overload conditions.

12. A time delay fuse in accordance with claim 11 wherein said heat sink is engaged to said fuse element at a warmest operating point of said fuse element.

13. A time delay fuse in accordance with claim 12 wherein said heat sink is disposed between said M effect alloy and said fuse link.

14. A time delay fuse in accordance with claim 13 wherein said heat sink is fabricated from nickel.

15. A time delay fuse in accordance with claim 13 wherein said fuse element comprises opposite outer surfaces, said heat sink engaged to and forming an electrical connection with said outer surfaces.

* * * * *